US007906747B2

(12) United States Patent
Poulalion

(10) Patent No.: US 7,906,747 B2
(45) Date of Patent: Mar. 15, 2011

(54) CORED WIRE

(75) Inventor: André Poulalion, Valenciennes (FR)

(73) Assignee: Affival, Solesmes (FR)

( * ) Notice: Subject to any disclaimer, the term of this patent is extended or adjusted under 35 U.S.C. 154(b) by 0 days.

(21) Appl. No.: 10/876,417

(22) Filed: Jun. 25, 2004

(65) Prior Publication Data

US 2005/0274773 A1 Dec. 15, 2005

(30) Foreign Application Priority Data

Jun. 10, 2004 (FR) ..... 04 06257

(51) Int. Cl.
*B23K 35/02* (2006.01)

(52) U.S. Cl. ..... 219/145.22; 219/145.41; 219/145.32; 219/146.1; 219/146.32

(58) Field of Classification Search ..... 219/145.22, 219/145.41, 145.32, 146.1, 146.32, 146; 75/304, 526; 428/379
See application file for complete search history.

(56) References Cited

U.S. PATENT DOCUMENTS

| | | | | | |
|---|---|---|---|---|---|
| 2,060,681 | A | * | 11/1936 | Miller et al. | 428/549 |
| 2,270,020 | A | * | 1/1942 | Graham | 219/145.41 |
| 2,619,456 | A | * | 11/1952 | Ingram | 204/248 |
| 2,705,196 | A | | 3/1955 | Wever et al. | |
| 3,056,190 | A | | 10/1962 | Chisholm et al. | |
| 3,353,808 | A | * | 11/1967 | Norburn | 239/589 |
| 3,467,167 | A | * | 9/1969 | Mahin | 164/473 |
| 3,632,096 | A | * | 1/1972 | Perry | 266/228 |
| 3,752,216 | A | * | 8/1973 | Fritsche | 164/509 |
| 3,768,999 | A | | 10/1973 | Ohkubo et al. | |
| 3,915,693 | A | | 10/1975 | Rasmussen | |
| 3,921,700 | A | | 11/1975 | Frantzreb, Sr. et al. | |
| 3,922,166 | A | * | 11/1975 | Koros et al. | 164/57.1 |
| 3,941,588 | A | * | 3/1976 | Dremann | 75/253 |
| 4,035,892 | A | | 7/1977 | Ototani et al. | |
| 4,057,420 | A | * | 11/1977 | Brace et al. | 75/10.49 |
| 4,085,252 | A | | 4/1978 | Karinthi et al. | |
| 4,097,267 | A | | 6/1978 | Baccaro et al. | |
| 4,134,196 | A | | 1/1979 | Yamaji et al. | |
| 4,147,962 | A | | 4/1979 | Engel | |
| 4,163,827 | A | | 8/1979 | Nieman et al. | |
| 4,199,351 | A | * | 4/1980 | El Gammal | 75/315 |
| 4,200,456 | A | * | 4/1980 | Fujii | 75/708 |
| 4,235,007 | A | | 11/1980 | Yamaji et al. | |
| 4,277,282 | A | * | 7/1981 | Guthrie et al. | 75/304 |
| 4,297,133 | A | | 10/1981 | Fujii | |
| 4,364,770 | A | | 12/1982 | Douchy et al. | |
| 4,481,032 | A | | 11/1984 | Kaiser | |
| 4,486,227 | A | | 12/1984 | Douchy et al. | |
| 4,652,299 | A | * | 3/1987 | Bienvenu et al. | 75/526 |
| 4,671,820 | A | | 6/1987 | Ototani et al. | |
| 4,698,095 | A | | 10/1987 | Ototani et al. | |
| 4,708,897 | A | | 11/1987 | Douchy | |
| 4,711,663 | A | | 12/1987 | Ferrari | |
| 4,738,714 | A | | 4/1988 | De Zeeuw | |

(Continued)

FOREIGN PATENT DOCUMENTS

| | | |
|---|---|---|
| EP | 0032874 | 7/1981 |

(Continued)

*Primary Examiner* — M. Alexandra Elve
(74) *Attorney, Agent, or Firm* — Ladas & Parry LLP

(57) ABSTRACT

Cored wire including at least one thermal barrier layer, distinguished by the fact that said layer is made of a material that pyrolizes upon contact with a metal bath such as liquid metal.

16 Claims, 10 Drawing Sheets

U.S. PATENT DOCUMENTS

| | | | | | |
|---|---|---|---|---|---|
| 4,765,599 | A | | 8/1988 | Ferrari | |
| 4,773,929 | A | * | 9/1988 | Weiner | 75/526 |
| 4,816,068 | A | * | 3/1989 | Douchy et al. | 75/304 |
| 4,832,742 | A | | 5/1989 | Ototani | |
| 4,863,803 | A | | 9/1989 | Douchy | |
| 4,906,292 | A | | 3/1990 | Douchy et al. | |
| 4,956,010 | A | * | 9/1990 | Douchy | 75/304 |
| 5,352,271 | A | * | 10/1994 | Margaria et al. | 75/526 |
| 5,376,160 | A | * | 12/1994 | Neuer et al. | 75/304 |
| 5,723,020 | A | * | 3/1998 | Robinson et al. | 162/159 |
| 6,053,960 | A | | 4/2000 | King et al. | |
| 6,280,497 | B1 | | 8/2001 | King et al. | |
| 6,346,135 | B1 | * | 2/2002 | King et al. | 75/304 |
| 6,508,857 | B2 | | 1/2003 | King et al. | |
| 6,770,366 | B2 | * | 8/2004 | Riche et al. | 428/379 |
| 2002/0025434 | A1 | * | 2/2002 | Riche et al. | 428/375 |

FOREIGN PATENT DOCUMENTS

| | | |
|---|---|---|
| EP | 0044183 | 1/1982 |
| EP | 0034994 | 12/1982 |
| EP | 0112259 | 6/1984 |
| EP | 0137618 | 4/1985 |
| EP | 0141760 | 11/1985 |
| EP | 0187997 | 12/1987 |
| EP | 0273178 | 7/1988 |
| EP | 0277664 | 8/1988 |
| EP | 0236246 | 3/1989 |
| EP | 0281485 | 9/1989 |
| EP | 0559589 | 10/1994 |
| FR | 2269581 | 11/1975 |
| FR | 2235200 | 8/1977 |
| FR | 2392120 | 6/1978 |
| FR | 2384029 | 8/1978 |
| FR | 2411237 | 4/1979 |
| FR | 2359661 | 5/1979 |
| FR | 2411238 | 11/1979 |
| FR | 2433584 | 3/1980 |
| FR | 2456781 | 12/1980 |
| FR | 2479266 | 10/1981 |
| FR | 2476542 | 12/1982 |
| FR | 2511039 | 2/1983 |
| FR | 2576320 | 7/1986 |
| FR | 2612945 | 9/1988 |
| FR | 2610331 | 9/1989 |
| FR | 2630131 | 9/1990 |
| FR | 2688231 | 10/1994 |
| FR | 2703334 | 10/1994 |
| FR | 2810919 | 2/2002 |
| FR | 2821626 | 9/2002 |

* cited by examiner

CORED WIRE

The invention is associated with the technical domain of tubular enclosures containing compacted powdered or granular materials, where these cored casings are used for the treatment of liquid metals, specifically steels iron and steel, and which are customarily called "cored wire".

Introducing these cored wires into a bath of liquid metal specifically allows refining, deoxidation, degassing, killing and/or modification of the composition of these baths.

Thus, for example, for desulfurization of blast furnace pig iron intended for conversion into steel, use has been made of cored wire containing Mg and $C_2Ca$ or even $Na_2CO_3$, $CaCO_3$, MgO.

Cored wires are typically used in secondary treatment (metallurgy) of steels, among other means, such as ladle stirring, powder injection, CAS (Composition Adjustment Sealed), ladle arc furnace, RH (Ruhrstahl Heraeus), and various vacuum processes.

Cored wires are primarily used for the desulfurization of cast irons, to produce GS cast irons, and for inoculating molding cast irons.

Inoculation of cast irons consists of introducing elements into the cast iron that promote germination of graphite, to the detriment of cementite, where these elements are, for example, alkalis, alkaline (Ca) or bismuth earths, alloyed with silicon. As a general rule, desulfurization, nodulizing and inoculation are carried out in order. Magnesium and silicon carbide are often used and bath temperatures are on the order of 1300 to 1400° C., i.e. lower than those of the liquid steel ladles.

The primary functions of cored wires are, for steels, deoxidants, desulfurization, inclusionary control and grade setting.

The process of deoxidation consists of combining oxygen dissolved in liquid steel coming from a converter or the electric furnace (content of about 500 ppm or more) with a deoxidizing agent, of which one part remains in the dissolved state in the liquid metal. Examination of the activity curves of the dissolved oxygen in the liquid iron at 1600° C., in equilibrium with various oxidizing elements, suggests that relatively modest addition of aluminum allows significant decrease in residual dissolved oxygen content, in order to form pure aluminum oxide. Because of this, aluminum is widely used as a deoxidizing agent for sheet steel products.

The liquid metal produced by the electric arc furnace is more or less decarburized, dephosphorized, but effervescent. Because of its dissolved oxygen content, the CO %×O % product is such that, at a certain temperature, the formation of gases is spontaneous within the liquid steel bath.

Henceforth deoxidization will be referred to as killing, in reference to eliminating this effervescence in the primary liquid steel bath.

Deoxidizing agents contained in the cored wire are most often ferrous alloys (ferro-silicon, ferro-manganese, aluminum). They cause formation of oxides (silica, manganese oxide, alumina) which, with moderate stirring of the ladle, are absorbed into the slag.

In spite of all precautions that may be taken, residual inclusions of alumina may cause blockage of casting nozzles or the appearance of flaws in final products of small cross-section, such as those coming from machines producing a continuous flow of thin slabs.

Killed aluminum steels may also typically contain calcium just as they could contain aluminum. The addition of calcium allows alloys to a killed liquid aluminum steel allows a modification of alumina inclusions, through partial reduction with calcium. Calcium aluminates are liquid at the temperature of liquid steels, around 1600° C., and therefore globular on the product when their CaO content is between 40% and 60% inclusive. The quantity of calcium in solution necessary to obtain modification of inclusions depends upon the aluminum content of the metallic bath. The greater part of the calcium introduced by the cored wire is therefore found, in the metal liquid, in the form of liquid inclusions of chalk aluminates, and does not exceed a few ppm.

In practice, it is difficult to avoid violent turbulence of the liquid steel, caused by the abrupt volatilization of the calcium contained in the cored wire. The vapor pressure of calcium is in fact around 1.8 atm at 1600° C. If the turbulence is too intense, it can disturb the penetration conditions of the cored wire in the steel bath and may be involve pollution of the bath, which may become oxidized or re-nitrided. At the same time, splashing of liquid steel may be produced, which cross the slag layer and become oxidized upon contact with air before falling off. Moreover, there is a risk that the steel will splash out of the ladle.

This may result in an increase in the content of $O_2$, $N_2$ and even $H_2$ in the resulting steel. Turbulence is reduced by introducing calcium, not non-alloyed, but in the form of CaSi, with the significant drawback of introducing silica into the liquid steel, which is unfavorable for certain steels such as those intended for deep drawing.

In order to remedy this drawback, introduction of calcium has been proposed, in the form of a CaNi alloy, possibly mixed with a little CaSi alloy. Other solutions are presented in document EP-0.190.089.

In order to remedy this drawback, we can also consider purging the volume located between the metal surface and the cover, by injecting argon in the case of steel with a low nitrogen concentration. In practice, since furnaces are not airtight, a strong argon purge causes an air intake and a weak argon current purge implies a prohibitive inerting time for the volume of gas above the liquid steel ladle.

It should also be noted that stirring or bubbling of argon through the porous plug in the ladle causes expansion of the surface of the slag, which further increases calcium loss through evaporation or oxidation, during simultaneous introduction of the cored wire, where expansion causes direct contact of liquid metal with air.

The apparent recovery of the addition of calcium is only the reflection of the inclusionary cleanliness of the metal. This recovery is low, and the greater part of the calcium added by the cored wire is lost by evaporation and/or by oxidation with the atmosphere, slag and refractories.

Therefore, it is very important, in order to minimize these secondary reactions, to add calcium after a proper purging of the oxidation inclusions and to adjust the addition to the desired rates of transformation for these inclusions.

Inclusions of exogenous oxygen resulting from contact of calcium with refractories or powders in the distributor are in fact difficult to eliminate before solidification of the metal. These alumina inclusions are solid and more noxious than calcium aluminate inclusions, those that plug continuous casting nozzles for example.

Treating a liquid steel, killed with aluminum, with a cored wire, can also cause formation of calcium sulfide, blocking the continuous casting nozzles, for steels with low aluminum and high sulfur content.

Controlling the inclusionary state by addition of chemical components lodged in cored wire essentially involves oxides and sulfides.

The addition of sulfur increases the quantity of manganese sulfides and the machinability of the steel.

In addition to calcium, selenium or tellurium allows us to modify the composition, morphology or rheological behavior of inclusions during subsequent deformations.

Control of inclusionary cleanliness is specifically very important for steels that are to be rolled, free cutting steel, steel for pneumatic armatures or steels for valve springs.

Deoxidization and control of the inclusionary state of steels, thanks to chemical additions by cored wire, are therefore complex operations that depend on the steel fabricator's know-how, operations for which the qualities of the cored wire are very important: notably, regularity of composition and compacting.

Now, manufacture and use of these cored wires presents a great number of practical problems, of which some will be noted below.

Insufficient or Irregular Compacting

Irregular compacting of the material contained in the enclosure translates into an irregularity in the quantities of the material introduced, per unit of time, into the steel bath or the metal liquid.

Insufficient compacting of the material contained in the cored wire reduces as much of the quantity, per unit time, of the material as we can introduce into the liquid metal by plunging the cored wire into the bath of liquid metal.

If compacting is insufficient, the pulverizing material can shift inside the cored wire.

Excessive Mechanical Forces Upon Unrolling

If the compacting process necessitates significant plastic deformation of the metallic envelope, increased rigidity, due to strain hardening, of the cored wire envelope, causes significant unrolling forces, in particular from drums of small diameter, with a small curve radius.

The term "drum" is used here to mean both storage reels, known as "dynamic", and walls of packaging cages called "static".

Insufficient Rigidity of the Welding Rod

Some cored wires, specifically of rectangular cross-section, have insufficient rigidity to allow them to be introduced into certain high-density metallic baths with any depth, especially if these baths are covered with a slag of high viscosity.

Spiral Deformation During Unrolling

We have been able to observe, during unrolling of cored wire stored on a static cage, spiral deformation of the wire, such that this cored wire does not penetrate into the liquid metal bath, but curves back on itself and remains on the surface.

Splitting of the Cored Wire Enclosure

We have observed, for certain products, during unrolling of the cored wire from its storage reel or its cage, or during straightening of the wire prior to its introduction into the liquid bath, a failure of the seam in the welding rod enclosure.

Other closure techniques for cored wire enclosure strips (bringing the strip edges together, overlapping, welding) have other drawbacks; excess thickness of the enclosure, which reduces the powder/liner ratio, poses a risk of deterioration of the powder during use.

Reduction in Time Required for Introduction into the Bath of a Given Quantity of Additives.

Increase in the speed of introduction of the wire into the bath can cause accidents if the wire hits the bottom of the receptacle or comes out of the bath before having enough time to melt.

Increase in wire diameter leads to an increase in rolling radius, and the spools required to roll up this type of wire then become too large to be easily used in the limited available space in the steel mill.

For information purposes, in order to introduce 1 kg of CaSi per ton of steel in a 150-ton ladle, i.e. 150 kg of CaSi powder placed in a wire with a density of 240 g/m, a length of 625 m of ored wire is required, where introduction of this kilometer of wire at 2 m/s represents a working time of more than five minutes.

Premature Destruction of the Cored Wire

If the cored wire casing is destroyed in a premature manner, by rapid melting immediately upon penetration into the metallic bath, the contents of the wire is released into the vicinity of the surface of the bath.

Deformation of the Rod, into a U, in the Liquid Metal Bath

It is, moreover, claimed in a document from prior practice that the cored wire can lose its rigidity and progressively curves into a U in the liquid metal bath in such a way that its end rises to the surface before the contents of the wire is liberated, where this rising action is due specifically to ferrostatic thrust, and where the apparent density of the wire is, in general, less than that of the metallic bath.

If the cored wire contains Ca, Mg, a release of these elements, at low depth in the liquid metal bath, causes very high losses in yield, for example for the desulfurization of cast irons.

Massive release of calcium at low depth in the liquid metal bath causes a violent reaction and splashing of liquid metal.

Insufficient Penetration Depth of the Cored Wire into the Liquid Metal Bath

As an example, U.S. Pat. No. 4,085,252 for which the following relationship between penetration depth L, thickness (e) of metallic envelope of the wire and the diameter (d) of a bar of Cerium:

$$L=1.7(e+0.35\,d)v\cdot 10^{-2}$$

where V is the speed of introduction of the wire, which is between 3 and 30 m/mn inclusive, for safety reasons.

If depth L is low, for example 30 cm, an increased risk exists that the product contained in the cored wire will not come into contact with the floating slag, and thus be lost.

If depth L is too low, there is also a risk of heterogeneity in distribution of the chemical element(s) contained in the cored wire, in the liquid metal bath.

Reactivity of Powders Contained in the Red Wire and Sealing of Continuous Flow Installations As indicated in U.S. Pat. No. 4,143,211, the chemical affinity of elements such as the rare earths, Al, Ca, Ti, for oxygen leads to the formation of oxides that may adhere to the internal walls of flow regulation nozzles in continuous casting installations and thus cause them to be blocked.

It is therefore necessary to provide steel fabricators with cored wire that facilitate homogeneous introduction of exactly the right quantity of reactant for the desired result (deoxidation, inclusionary control, mechanical resistance, etc. . . . ) for the final steel product.

In order to attempt to resolve at least one of these technical problems, a very large number of structures and manufacturing processes for cored wire have been proposed in prior practice, for example illustrated in the following documents:

European patent applications published under numbers: 0.032.874, 0.034.994, 0.044.183, 0.112.259, 0.137.618, 0.141.760, 0.187.997, 0.236.246, 0.273.178, 0.277.664, 0.281.485, 0.559.589;

French patent applications published under numbers: 2.235.200, 2.269.581, 2.359.661, 2.384.029, 2.392.120, 2.411.237, 2.411.238, 2.433.584, 2.456.781, 2.476.542, 2.479.266, 2.511.039, 2.576.320, 2.610.331, 2.612.945, 2.630.131, 2.688.231;

American patents published under numbers: 2.705.196, 3.056.190, 3.768.999, 3.915.693, 3.921.700, 4.085.252, 4.134.196, 4.147.962, 4.163.827, 4.035.892, 4.097.267, 4.235.007, 4.364.770, 4.481.032, 4.486.227, 4.671.820, 4.698.095, 4.708.897, 4.711.663, 4.738.714, 4.765.599, 4.773.929, 4.816.068, 4.832.742, 4.863.803, 4.906.292, 4.956.010, 6.053.960, 6.280.497, 6.346.135, 6.508.857.

Succinct presentation of a few of the foregoing documents shows the great variety of technical solutions being considered in order to respond to the various technical problems set out in the introduction.

Document EP-B2-1000.236.246 describes a cored wire that consists of a metallic envelope seamed by a fold finished at the circumference, closed upon itself and whose edge is engaged inside the compacted mass that forms the core of the cored wire.

Seaming is carried out along a profiling plate of the cored wire enclosure, and may be reinforced by lock-seam forming with transverse indentations over the entire width of the seaming band. Compacting the cored wire core is obtained by formation of an open fold, opposite the seaming area, then closing of this fold by radial pressure.

The cored wire enclosure is made of steel or aluminum and contains, for example, a powdered alloy of CaSi with 30% Ca by weight.

Document U.S. Pat. No. 4,163,827 describes a cored wire that comprises a core with a ferrosilicon base, consisting of Ca, Al, in powder form submerged in a resin or binding polymer such as polyurethane, where this core is extruded before being enclosed by single or double helix rolling of a thin strip of metal, plastic or paper, of a thickness of 0.025 mm to 0.15 mm. This type of cored wire has numerous drawbacks. In the first place, materials forming the resin are a source of pollution that is unacceptable for the liquid metal bath. In the second place, mechanical sturdiness and rigidity of the wire are very insufficient.

In the third place, the ferrosilicon powder is practically unprotected with regard to the increased temperature of the liquid metal.

Document EP-0.032.874 describes a cored wire consisting of a metallic welding liner of thin sheet containing an additive surrounded at least partially by an envelope of synthetic organic or metallic material in the form of a sheet of thickness less than 100 microns. The wire is of a flattened shape. The thin sheet is of polyethylene, polyester or polyvinyl chloride and forms a means of water-tightness, which may be thermo-retractable. No manufacturing process is described for this flattened cored wire, whose concept appears to be more of a figment of the imagination than an industrial revelation.

Document FR-2.610.331 from the applicant describes a cored wire that comprises an axial area containing a primary powdered or granular material, surrounded by an intermediate metallic tubular wall, and an annular area, located between this intermediate wall and the cored wire enclosure, where this annular zone contains a second powdered or granular material. The axial zone contains, favorably, the materials that are the most reactive with regard to the bath being treated.

As long as the external metallic envelope of this cored wire is not destroyed, the material that fills the annular zone plays the role of heat insulator, which reduces the increase in temperature of the intermediate wall, thus reducing risks of flexion of the wire, which would prevent it from entering the bath, since the intermediate wall retains a certain rigidity.

Document U.S. Pat. No. 3,921,700 describes a cored wire with a steel enclosure, which contains an axial magnesium wire and an iron powder, of low thermal conductivity and of high calorific capacity, thus forming a thermal insulator that protects the magnesium from heating too quickly when the cored wire is immersed in the liquid steel. As a variation, graphite or carbon is mixed with the iron powder.

Among the technical problems posed by the use of cored wire, several arise from that fact that it is practically impossible to determine what exactly is happening to this wire when it is immersed in the liquid metal bath, such as a steel ladle at 1600° C. In particular, the following questions are delicate ones: what is the shape of the rod in the bath (straight, curved into a U), to what depth is it destroyed by melting? In the prior art, nothing is found on this subject except compartmentalized and sometimes contradictory information.

Thus, document FR-2.384.029 describes an inoculation wire consisting of a steel enclosure, lining a composite of tamped powdered ferrosilicon, with more than 65% silicon by weight. According to this earlier document, silicon diffuses towards the wire's steel enclosure, during its introduction into the liquid metal, in such a way that:

- the melting temperature of the inoculate contained in the wire will decrease;
- the melting temperature of the steel in the wire lining will decrease where the carbon diffuses through the exterior surface of the wire lining.

According to this earlier document, a cored wire comprising a mild steel lining (melting temperature 1538° C.) comprising a ferrosilicon of 75% silicon (melting temperature 1300° C.) will melt at about 1200° C. when immersed, for example, into a gray cast iron at 1400° C., where this melting emanates from the internal part of the lining, due to the fact that the diffusion of silicon in the lining which lowers the melting temperature of the mild steel.

Document U.S. Pat. No. 4,174,962 mentions, besides this diffusion of silicon, a dissolution of the exterior wall of the cored wire lining, by erosion and diffusion, even if the melting temperature of the lining is greater than that of the temperature of the liquid metal bath.

Document U.S. Pat. No. 4,297,133 describes a tube of paper rolled into layers, where this tube is closed with metallic membrane seals. Combustion time for the paper is indicated as being three seconds when the tube is placed in a bath of liquid steel at 1600-1700° C.

The applicant has herself described, in publications FR-2.821.626 and FR-2.810-919 the cored wire having enclosures which, since they are combustible without leaving harmful residues, momentarily slow propagation of heat towards the heart of the wire, since these enclosures are of paper known as pyrotechnical application paper, which is combustible and thermally insulating.

According to these two earlier documents by the applicant, by increasing the number of layers of paper, explosion of the cored wire containing calcium, or vaporization of this calcium, is slowed, and we are thus able to introduce the cored wire to a sufficient depth in the liquid metal bath to avoid a surface reaction of the bath with the contents in the wire, as well as the risks that arise from it: oxidation and/or re-nitriding of the bath, splashing of liquid metal, emanation of smoke, very low yield of the process of introducing additives by cored wire.

According to these earlier documents, the slow combustion of the pyrotechnic paper does not cause the appearance of combustion residues that affect the composition of the liquid metal bath and does not produce inclusions which alter the behavior of the bath as it flows. In the embodiment described by document FR-2.821.626, above this envelope of burning pyrotechnic paper without leaving harmful traces in the liquid metal bath, metallic protection is applied in order to prevent the layers of pyrotechnic paper from becoming damaged as they are being rolled onto the cored wire reel or when the cored wire is being unrolled from this reel.

The applicant was also puzzled when the cored wire described in documents FR-2.821.626 or FR-2.810.919 do not always give a yield that is very superior to that of the cored wire that have been stripped of the bands of paper rolled in a helix.

The applicant has resolved to find a solution to this technical problem, by providing, moreover, a cored wire whose life span in the liquid metal bath is either increased, relative to conventional wires, such that it can reach a predetermined depth in the liquid metal bath.

The applicant, after complex and lengthy tests, discovered, notably:

1) that it is important to avoid all combustion of coiled paper described in documents FR-2.821.626 and FR-2.810.919, before the cored wire enters the liquid metal bath (free passage zone of the welding rod);

2) a means for avoiding this combustion;

3) that the increase in lifespan of the cored wire was ensured when the combustion of the paper did not take place before the welding red cored wire entered the liquid metal bath, since the paper was not necessarily pyrotechnical, or M1 class, or of increased resistance to ignition, contrary to what is indicated in FR-2.821.626 or FR-2.810.919, since the paper does not burn in the liquid metal bath, but pyrolizes so that it transforms into a material whose thermophysical properties are at this time unknown to the applicant, because this pyrolysis is not achieved except with respect to certain measures which are detailed below.

The applicant has thus discovered an inexpensive and reliable means for increasing the life span of cored wire in liquid metal baths, where these means are compatible with all structures previously described for cored wire, and these means thus bring about a favorable technical effect over and above each of the individual advantages of the various types of previously known cored wire.

The invention therefore relates, according to its first aspect, to a cored wire, which consists of at least one thermal barrier layer, where said layer is made of a material that pyrolizes upon contact with a bath of a metal such as liquid steel.

According to various methods of embodiment, the cored wire comprises the following characteristics, if such is the case, in combination,

- It comprises an external thermal barrier layer, which encloses a metallic liner, where said external thermal barrier layer is made of a material that pyrolizes upon contact with a bath of liquid metal;
- The pyrolizing material is Kraft paper, aluminized paper or multiplayer paper consisting of at least one strip of Kraft paper and at least one layer of aluminized paper;
- The pyrolizing material is covered with a thin metallic sheet;
- The thin metallic sheet is made of aluminum or aluminum alloy;
- The pyrolizing material has a thermal conductivity of between 0.15 and 4 W/m.K inclusive, before pyrolysis;
- The pyrolizing material has a temperature at start of pyrolysis on an order of 500° C.;
- The pyrolizing material is loaded with water or a chemical compound with high latent heat of vaporization, specifically, one higher than 2 MJ/kg;
- The pyrolizing material consists of a layer of moistened paper;
- the pyrolizing material is affixed by gluing it to a metallic liner inside the welding-rod cored wire;
- the pyrolizing material is placed between a metallic liner inside the wire and an external metallic enclosure;
- the external metallic enclosure is seamed, with the pyrolizing material placed in between in the seaming band, so that all direct metal/metal contact in the seaming band is prevented;
- the internal metallic liner is of radial thickness of between about 0.2 and 0.6 mm inclusive, where the external metallic enclosure is of a radial thickness of between about 0.2 and 0.6 mm inclusive;
- the pyrolizing material is a Kraft paper, single or multiplayer, of a thickness between 0.1 and 0.8 mm inclusive;
- the cored wire comprises, at least one material chosen from among the group consisting of Ca, Bi, Nb, Mg, CaSi, C, Mn, Si, Cr, Ti, B, S, Se, Te, Pb, $CaC_2$, $Na_2CO_3$, $CaCO_3$, CaO, MgO, rare earths, in powder form, compacted grains or grains immersed in resin.

Other objects and advantages of the invention shall become apparent during the following description of methods of embodiment, where this description shall be made with reference to the attached drawings, in which.

Figure 1:
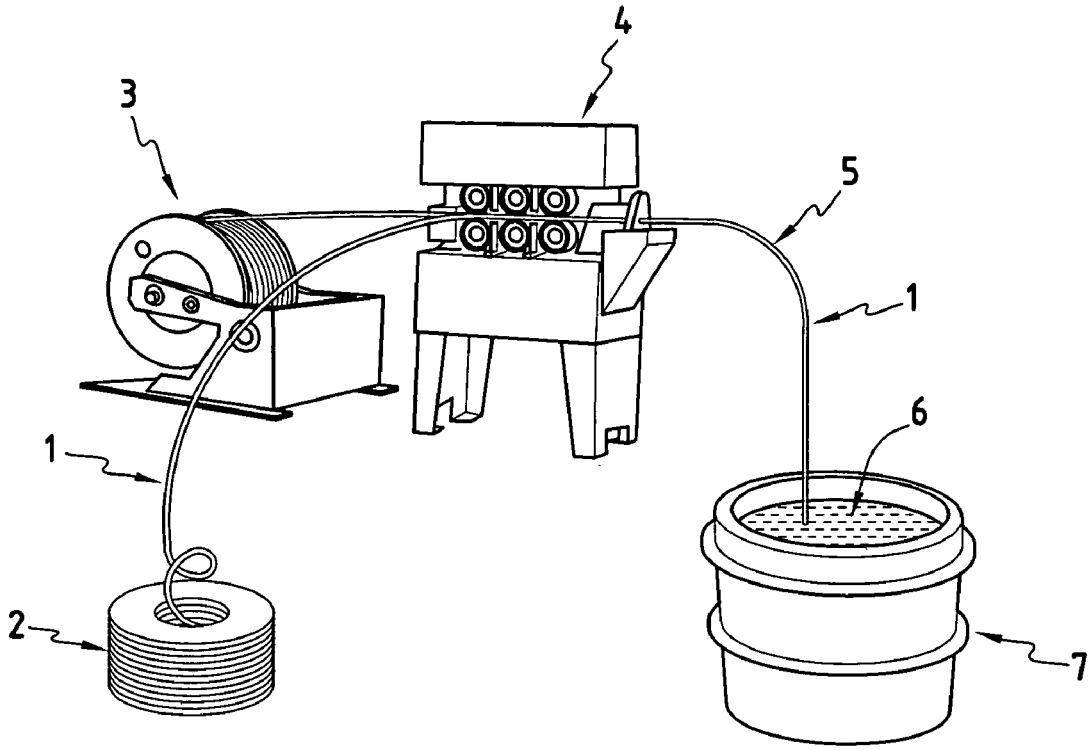
FIG. 1 is a representative of the principle of introduction of the cored wire into a liquid steel bath.

We refer first of all to FIG. 1, which is a representation of the principle of introduction of a cored wire into a ladle of liquid steel.

Cored wire (1) is removed from a cage (2) such as, for example, that described in document FR-2.703.334 by the applicant, or even removed from a reel (3), and introduced into an injector (4).

This injector (4) draws the wire into an elbow-bend guide tube (5), and the cored wire comes out of the guide tube (5) at a height on the order of 1.00 to 1.40 meters above the surface of the liquid steel bath (6) contained in a ladle (7).

The cored wire(1) is thus located in three mediums that are very different thermally:

- the first medium, in which the cored wire is lodged inside the guide tube;
- the second medium, located above the liquid steel bath in which the cored wire is placed in direct contact with the surrounding atmosphere;
- a third medium which is the steel or liquid metal bath itself.

The applicant wished, first of all, to thermally simulate the path of the cored wire in order to limit the number of tests conducted with instrumented cored wire.

For this model, three-dimensional radiating exchanges between a flat, opaque, gray and diffuse surface were simulated by calculating shape and transfer factors.

Shape factors were calculated by the flat flux method, and transfer factors were calculated by the coating method, taking diffuse multi-reflections into account.

Inside the guide tube, the flux received is assumed to be radiating out of the tube encasing the cored wire with a shape factor equal to 1.

For free travel of the cored wire after it exits guide tube (5) and before it enters liquid metal bath (6), the flux is considered to be by radiation but emanating from liquid metal bath (6) and the walls of ladle (7).

Inside liquid metal bath (6), transfer is considered to be by convection with a coefficient of exchange on the order of 50,000 $W/m^2K$, where the surface temperature is imposed.

Total emissivity of the external surface of the cored wire is considered to be equal to 0.8, and that of the guide tube is equal to 1 whereas that of the bath is considered to be equal to 0.8.

Radiating thermal flux exchanged, in compliance with the STEFAN-BOLTZMANN law, is of the form:

$$\phi=\epsilon\times F\times\sigma\times(T^4_1-T^4_2)$$

with:

$\phi$ thermal flux exchanged between the two surfaces, in $W/m^2$ $\epsilon$ coefficient that takes the emissivities of the two surfaces into account, F shape factor that takes into account the surfaces, shapes and orientation of the two surfaces relative to each other, $\sigma$ STEFAN-BOLTZMANN constant, equal to $5.67\times10^{-8}$ $W/m^2K$ $T_1$ and $T_2$ are absolute temperatures in Kelvins of the two surfaces, with $T_1$ greater than $T_2$.

Figure 2:
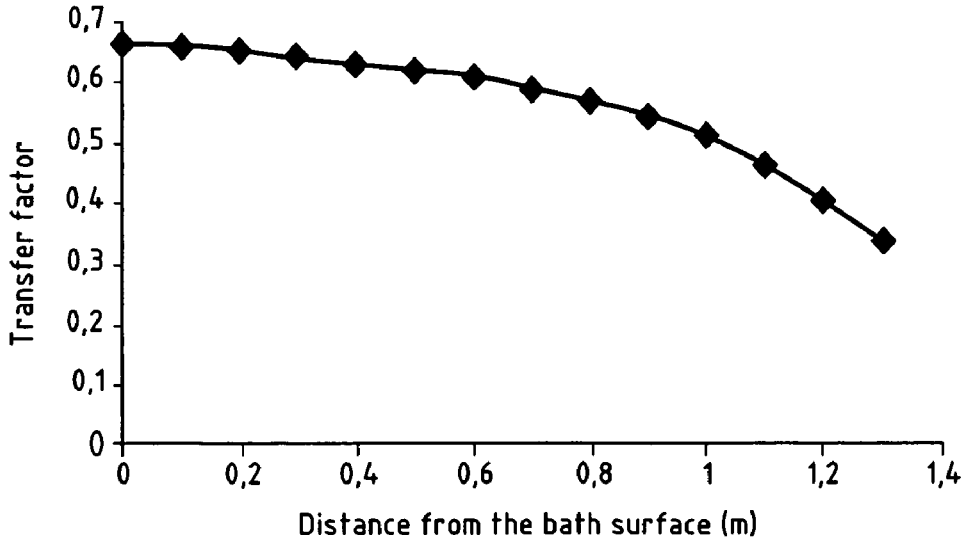
FIGS. 2 through 12 are temperature curves as a function of time, resulting from numerical simulation.

FIG. 2 gives the variation of the transfer factor between the cored wire and the liquid metal bath ($\epsilon\times F$) as a function of the distance above this liquid metal bath, where the value zero on the abscissa axis corresponds to the surface of the liquid metal bath.

The cored wire is considered to consist of three concentric cylindrical layers, namely, a core of calcium lined with steel, where this steel liner is covered with paper.

For numerical simulation, the diameter of the calcium core is 7.8 mm, the thickness of the steel liner is 0.6 mm whereas the thickness of the paper may be set at different values, for example 0.6 mm for eight layers of stacked paper.

For the simulation, the cored wire is considered to be shaped with a solid calcium core, encased by and in contact with a steel liner that is itself encased by and in contact with the paper.

Guide tube (5) is represented by a hollow steel cylinder of constant temperature, which gives an energy to the cored wire during time+1, such that:

+1=L1/V where

L1 is the length of guide tube (5) and

V is the speed of cored wire passage into tube (5).

The liquid metal bath and the walls of ladle (7) are represented in the numerical model by a temperature volume equal to 1600° with radiation and convection towards the cored wire according to which the wire is located above bath (6) or in this liquid metal bath (6).

Heat exchange is by convection, with a very high coefficient of exchange (50,000 $W/m^2K$) starting with temperature T2 where the cored wire enters the liquid metal bath (6).

T2 is calculated as follows:

T2=L1+L2/V where:

L2 is the distance between the extreme lower part of guide tube (5) ad the surface of the liquid metal bath (6).

The tapering speed of the cored wire is equal to 2 m/s, where the initial temperature of the is at 50° C.

Free travel of the cored wire beyond guide tube (5) and before introduction into the liquid metal bath is considered to be of a length equal to 1.4 m.

The wire is considered to be destroyed when, by calculation, the surface of the calcium core has a temperature greater than 1400° C.

Figure 3:
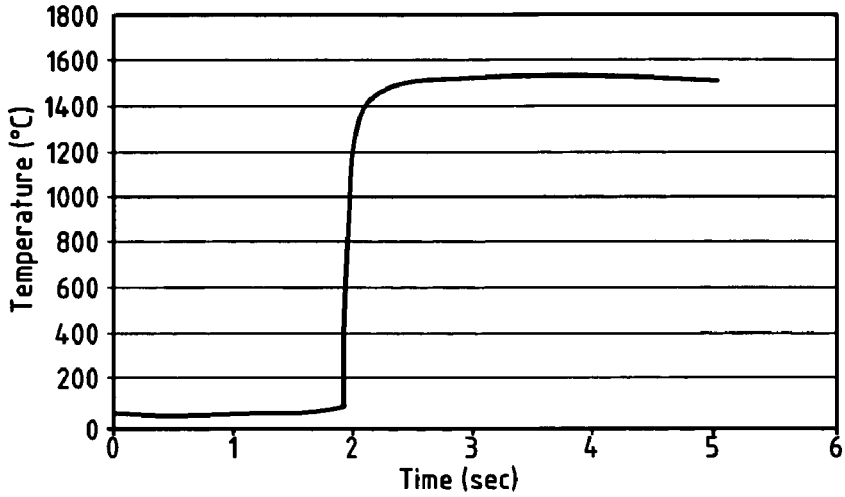

As shown in FIG. 3, the model indicates that, for a reference wire that has get no thermal protection, the surface temperature of the calcium core increases by 70° C. only during free travel and that it reaches the threshold of 1400° C. in 0.15 sec. after a journey of only 30 cm only into the liquid metal bath only for a speed of 2 m/s.

The temperature gradient between the steel liner and the calcium core, by calculation, does not exceed 65° C.

Thus, when the temperature of the surface of the calcium core is 1400° C., the temperature on the exterior surface of the steel liner is 1465° C., such that the steel liner does not melt before the cored wire is destroyed, where the latent heat of fusion of this steel liner is not therefore taken into consideration during numerical simulation.

Figure 4:
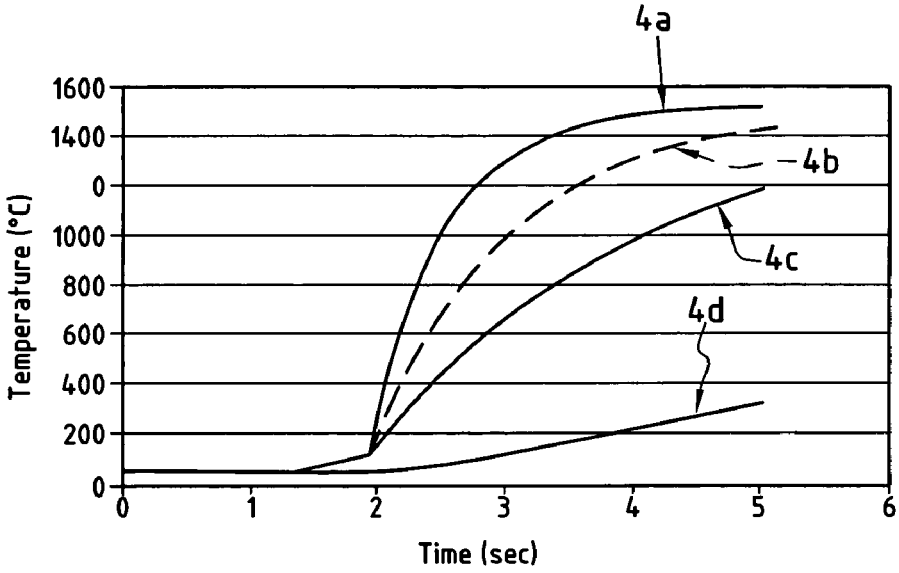

FIG. 4 gives four curves of temperature progress of the surface of the calcium core of a cored wire as a function of time, where each of these four curves corresponds to a different thickness of protection paper, namely;

0.025 mm for curve 4*a*, 0.05 mm for curve 4*b*, 0.1 mm for curve 4*c*, 0.6 mm for curve 4*d*

Comparison of FIGS. 3 and 4 shows, by numerical simulation, a protective effect of the paper surrounding the steel liner, where the effect of this paper increases as the paper thickness is increased.

The curves shown in FIG. 4 were obtained by considering that the paper layers remained intact, without combustion.

According to this hypothesis, insulation of thickness 0.025 mm would suffice to protect the cored wire until it reaches the bottom of the liquid metal bath.

But the combustion temperature of the paper is around 550° C.

A study of the temperature increase of the surface of the paper during free travel was carried out, neglecting the effect of convection relative to radiation, which is in fact preponderant.

Figure 5:
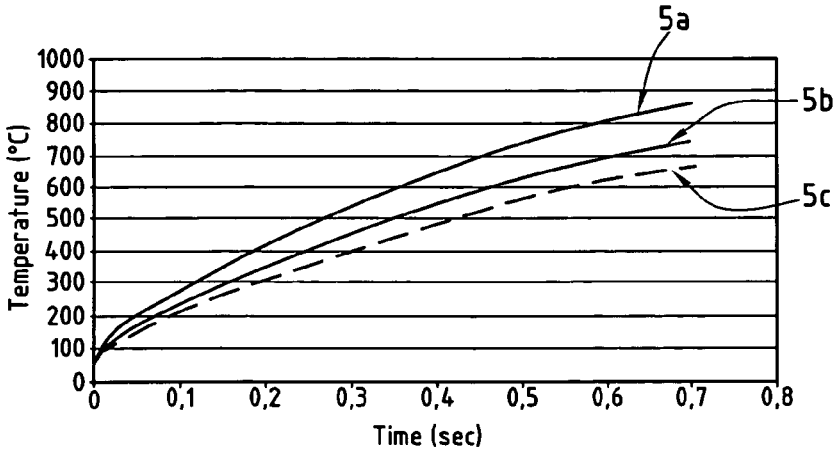

FIG. 5 shows the development of surface temperatures of the paper as a function of the conductivity of this paper, during the first second of free travel of the cored wire, where the thickness of the paper is 0.6 mm, and where the speed of uncoiling of the cored wire is 2 m/s.

Curve 5*a* corresponds to a conductivity of 0.1 W/K.m, curve 5*b* corresponds to a conductivity of 0.15 W/K.m and curve 5*c* corresponds to a conductivity of 0.2 W/K.m.

FIG. 5 shows that the combustion of the paper is probable and the destruction of the paper during free travel of cored wire is not excluded.

Figure 6:
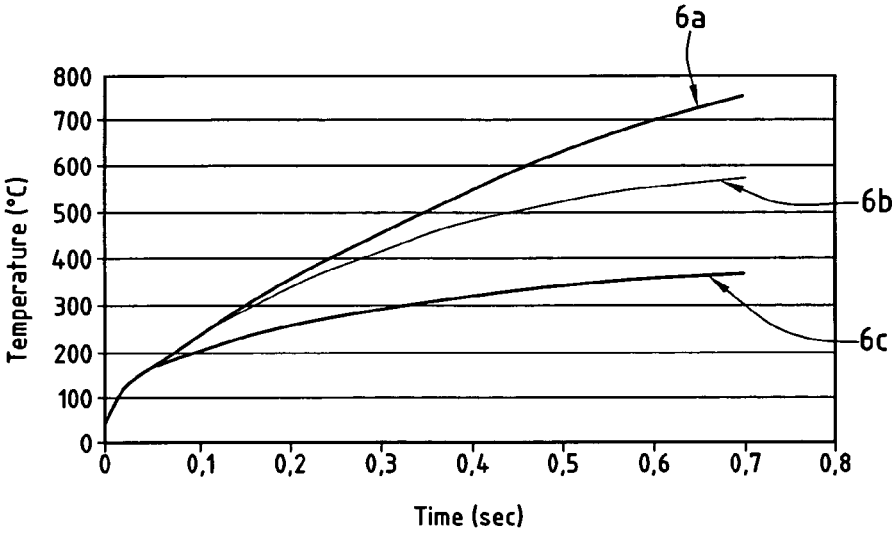

FIG. 6 shows the progress of the surface temperature of the paper for a thermal conductivity of this paper of 0.15 W/K.m, a speed of injection of the welding rod cored wire of 2 m/s, where the thickness of the curved paper 6*a* is 0.6 mm, of curve 6*b* is 0.2 mm and curve 6*c* is 0.1 mm.

FIG. 6 suggests that by decreasing the thickness of the paper, the surface temperature of this paper is lowered and therefore the risk of combustion of this paper during free travel of the cored wire above the liquid metal bath.

Figure 7:
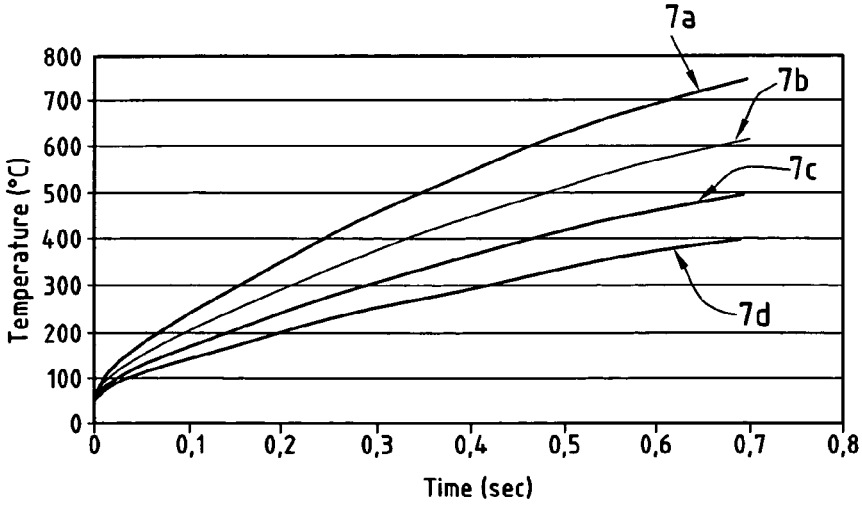

As the experienced craftsman will know, the surface of a liquid metal bath such as steel is covered with a layer of slag that forms a thermal screen, FIG. 7 shows that the temperature of the paper covering the cored wire is broadly affected by the variation in temperature of the source of radiation.

Curves 7*a*, 7*b*, 7*c* and 7*d* correspond, respectively, to temperatures of emitting surfaces of 1500, 1400, 1300 and 1200° C.

For the simulation shown in FIG. 7, the speed of injection of the cored wire was 2 m/s and thermal conductivity of the paper was 0.15 W/K.m.

Through these numerical simulations, which were confirmed through experimental testing, the applicant was able to establish the hypothesis that the variability of the results obtained during implementation of a structure such as the one described in document FR-2.810.919 results in a combustion of paper during free travel of the cored wire above the liquid metal bath, and, after this point, the paper no longer has its effect of thermal protection upon the cored wire, once it is inside the liquid steel bath.

The applicant has established the following additional hypothesis: the paper pyrolyzes, and does not burn, inside the liquid steel bath.

Then the applicant went forward with numerical simulations by considering the paper to be a body that had two different thermal conductivities depending on temperature:

a first conductivity, that of the original paper (0.15 W/K.m), where this first conductivity is maintained until it reaches a temperature on an order of 500° C. at start of pyrolysis;

a second conductivity (300 W/K.m), which is assumed to be reached when the temperature of the pyrolized paper is 600° C., where pyrolysis is assumed to be terminated when this temperature of 600° C. has been reached.

Between 500 and 600° C., passage of the conductivity from 0.15 W/K.m to 300 W/K.m is assumed to be linear, in the simulation as a function of temperature.

Figure 8:
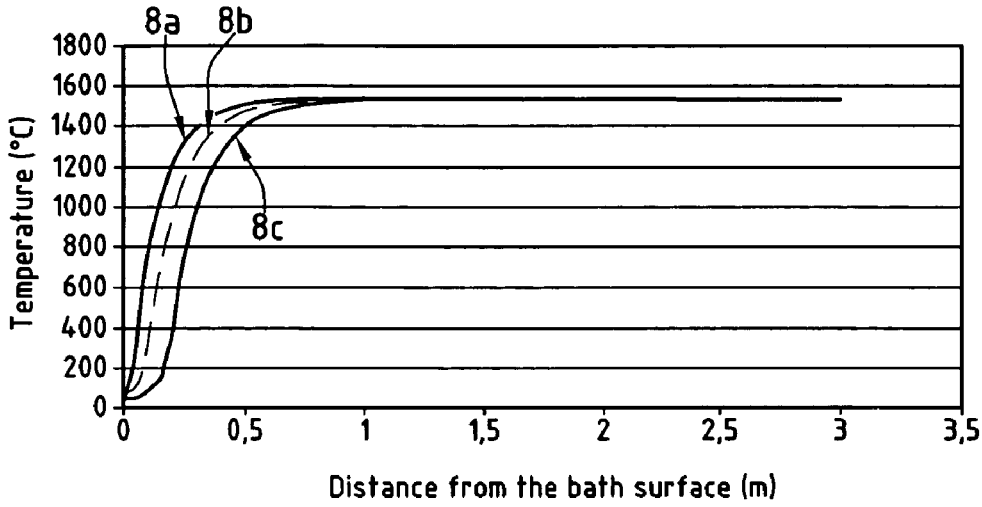
Figure 9:
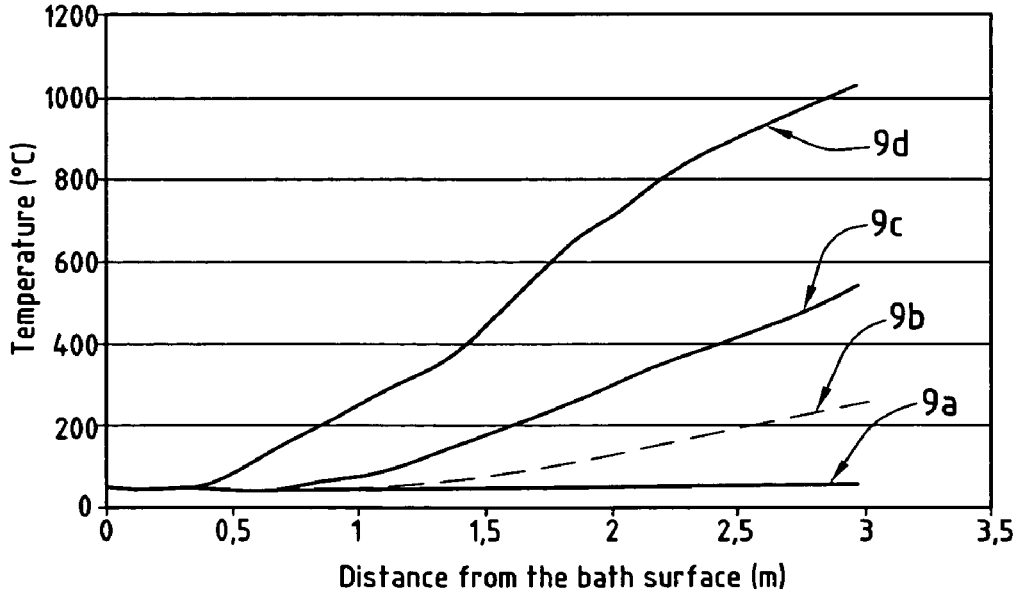

FIG. 8 gives the results of the numerical simulation for the surface temperature of the calcium contained in the cored wire, where the paper is assumed to be dissolved in the liquid metal bath, just after it is pyrolyzed.

Curve 8*a* corresponds to the conventional cored wire, without protective paper.

Curve 8*b* corresponds to a that has been provided with protective paper of a thickness of 0.6 mm.

Curve 8*c* corresponds to a cored wire that has been provided with protective paper of a thickness of 1.2 mm.

FIG. 8 suggests that, if the paper disappears after its pyrolysis, it is not possible to protect the cored wire so that it reaches the bottom of the steel bath, not even by doubling the thickness of the paper.

Now, the applicant has determined that, during industrial testing, the welding cored wire sometimes reaches the bottom of the bath when the wire is covered with protective paper.

It is therefore probable that the paper does not disappear after pyrolysis inside the liquid steel bath.

Pyrolysis of the Kraft paper was carried out by increasing the temperature of the sheets of paper, in the absence of oxygen, until a temperature of about 600 C. has been reached and measurement of the thermal conductivity of the paper has been carried out, before and after pyrolysis.

It becomes apparent from this study that the thermal conductivity of the paper varies little after its pyrolysis.

The applicant therefore carried out the numerical simulation again, this time considering, in contrast with the hypothesis corresponding to FIG. 8, that the paper does not disappear after pyrolysis, where the conductivity of the paper after pyrolysis is considered to be 0.15, 1, 2, 4 W/K.m for curves 9*a*, 9*b*, 9*c*, 9*d* respectively. This simulation better reflects the test results, as we shall see later.

In order to avoid all combustion of the paper enclosing the steel lining of the cored wire, the applicant has envisioned absorbing the radiation, or reflecting it by moistening this paper or by coating it with aluminum.

Figure 10:
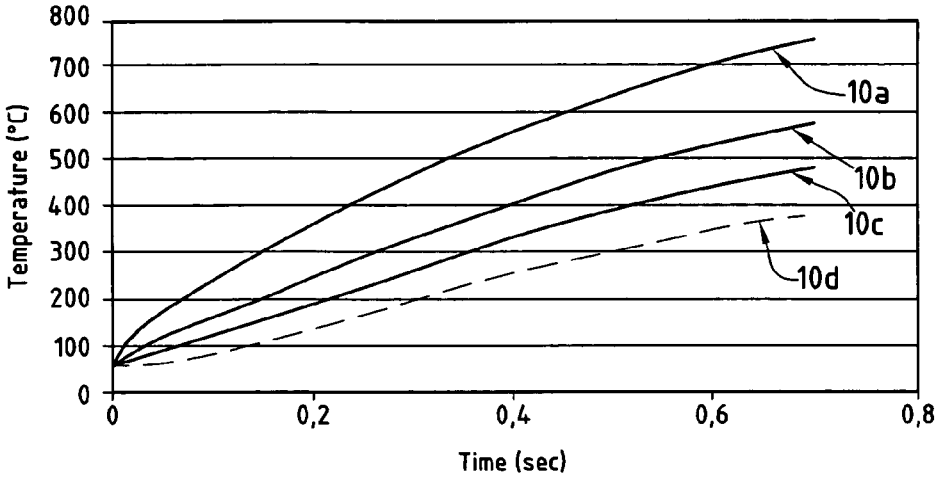

FIG. 10 shows the results of the numerical simulation for variations in temperature of the paper surface as a function of time, where curves 10*a*, 10*b*, 10*c* and 10*d* correspond, respectively, to a moisture of 0%, 59%, 89% and 118%.

For this simulation shown in FIG. 10, the speed of injection of the cored wire is 2 m/s, where thermal conductivity of the paper is 0.15 W/K.m.

Figure 11:
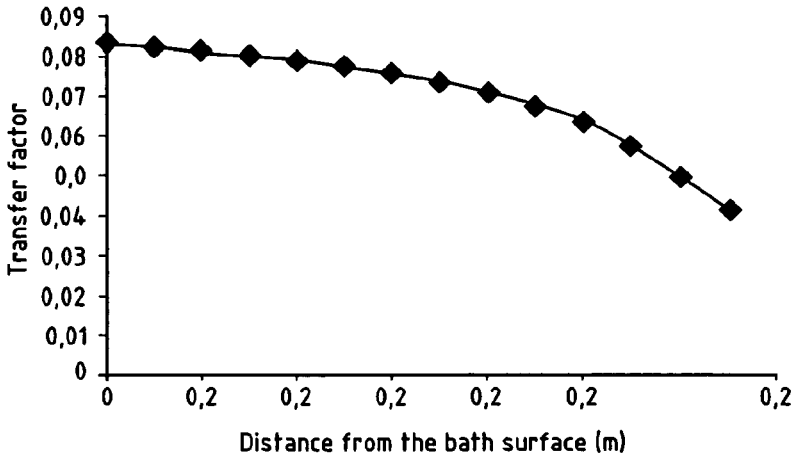

FIG. 11 gives the result of the radiation calculation carried out by adding a very thin layer of aluminum as a coating on the paper enclosing the steel lining of the cored wire.

This FIG. 11 shows that the radiation transfer factor is reduced by a factor 8 compared to that of the paper whose emissivity is 0.8.

Figure 12:
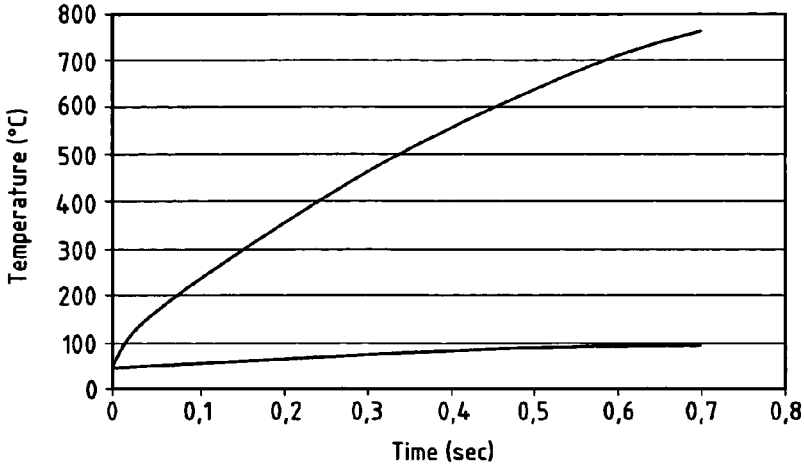

FIG. 12 allows us to compare the developments of surface temperature of paper as a function of time, with and without aluminum coating, where the injection speed of the cored wire remains at 2 m/s and the thermal conductivity of the paper is 0.15 W/K.m.

The surface temperature of the paper increases very little, according to this numerical simulation, during the free travel of the cored wire, where the aluminum assures a very effective thermal protection for the paper on the welding red cored wire.

In order to verify the hypotheses formulated by the applicant during the simulations presented above, tests were carried out by the applicant with the help of an instrumented cored wire.

The instrumented cored wire is fabricated in three stages:

emptying the cored wire;

positioning thermo-couples in contact with the internal steel lining of the cored wire, opposite the seaming area;

filling the cored wire with powder.

Electrical connections and thermocouple plug-in wires are protected by a steel tube.

The instrumented wire is introduced into a steel mill liquid steel ladle, then removed after a predetermined period of time.

The baths are permanently blended with argon, which creates an inert ambiance in the free travel above the surface of the liquid steel bath, which limits risk of accidental combustion of the paper on the welding rod.

In FIGS. 13 to 21, point 1 corresponds to the entry of the cored wire into the liquid steel ladle.

Figure 13:
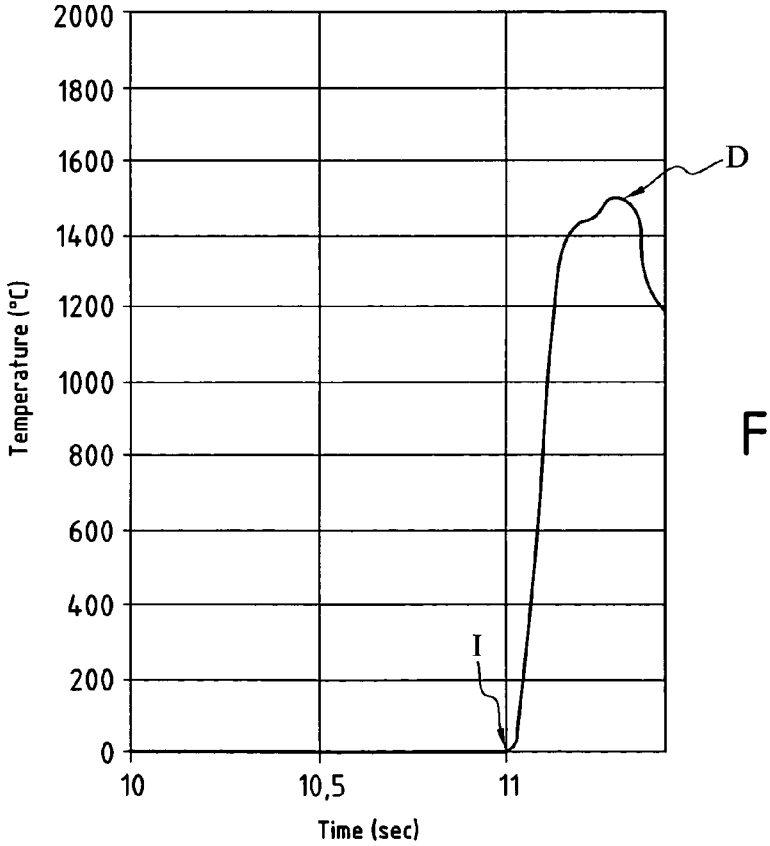
FIGS. 13 to 21 are temperature curves as a function of time, and are results of testing programs directed by the applicant.

Initially, a reference test was carried out with a cored wire that is not covered with paper, and where the variation in temperature inside the reference cored wire, as a function of time, is given in FIG. 13.

The drop in temperature at point D in FIG. 13 is associated with the destruction of thermocouples.

Figure 14:
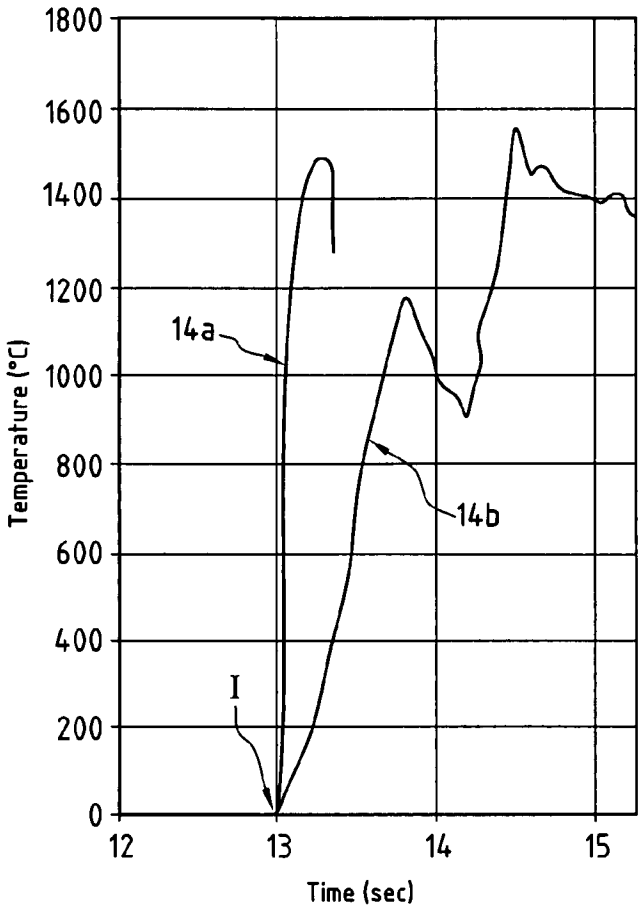

FIG. 14 compares the results obtained with the reference wire (reference 14*a*) and a cored wire comprising a layer of Kraft paper placed between the calcium core and the steel lining (reference 14*b*).

With regard to this FIG. 14, the application of Kraft paper inside the cored wire allows us to delay the increase in temperature by 0.4 seconds, or a total time of 0.7 seconds before destruction.

Figure 15:
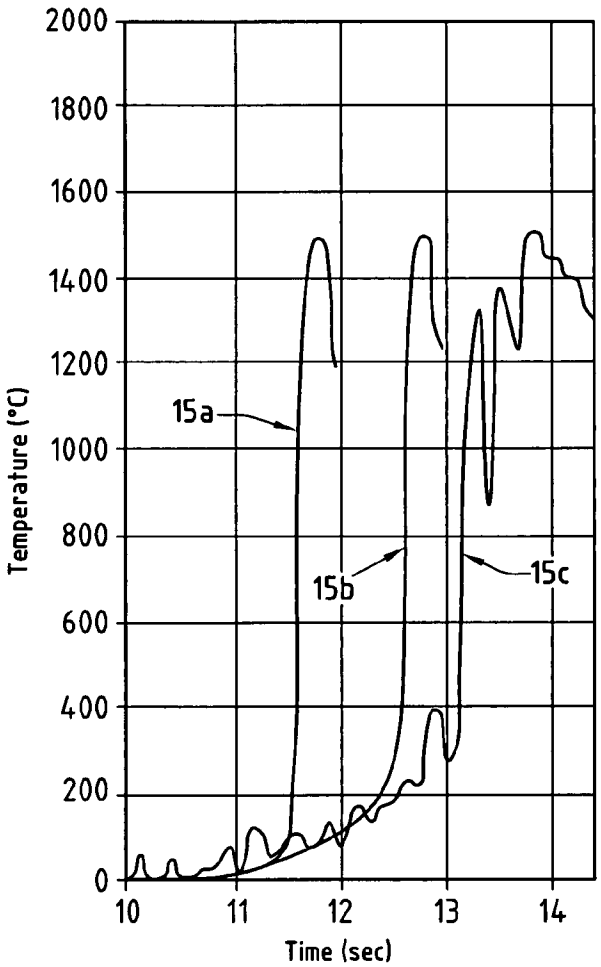

FIG. 15 compares the results obtained with the reference rod (curve 15*a*) and two instrumented wires equipped with two external layers of Kraft paper (curves 15*b*, 15*c*).

The delay in increase in temperature obtained is 0.8 and 1.2 seconds allows the cored wire to reach the bottom of the ladle.

The sharp increase in temperature of curves 15*b* and 15*c* corresponds to the moment where the Kraft paper is completely degraded, since the steel lining of the cored wire comes into direct contact with the liquid steel bath.

Figure 16:
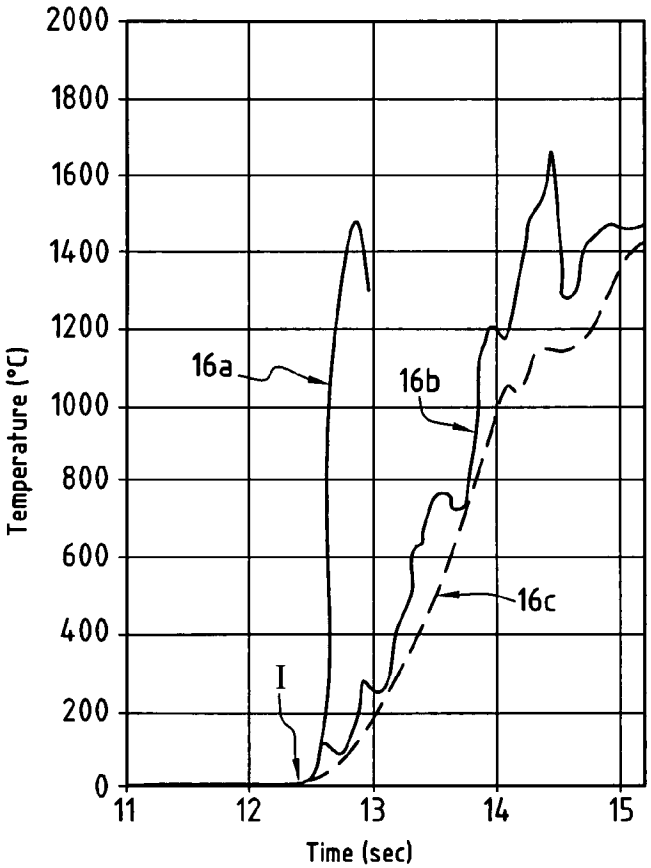

FIG. 16 allows us to compare the results obtained with the reference wire (curve 16*a*) and a cored wire protected by two layers of Kraft paper and two layers of aluminized paper (two test curves 16*b* and 16*c*).

The curves in FIG. 16 show that the presence of two layers of Kraft paper and two layers of aluminized paper slow the increase in temperature by about 1 second, relative to a conventional reference wire.

Figure 17:
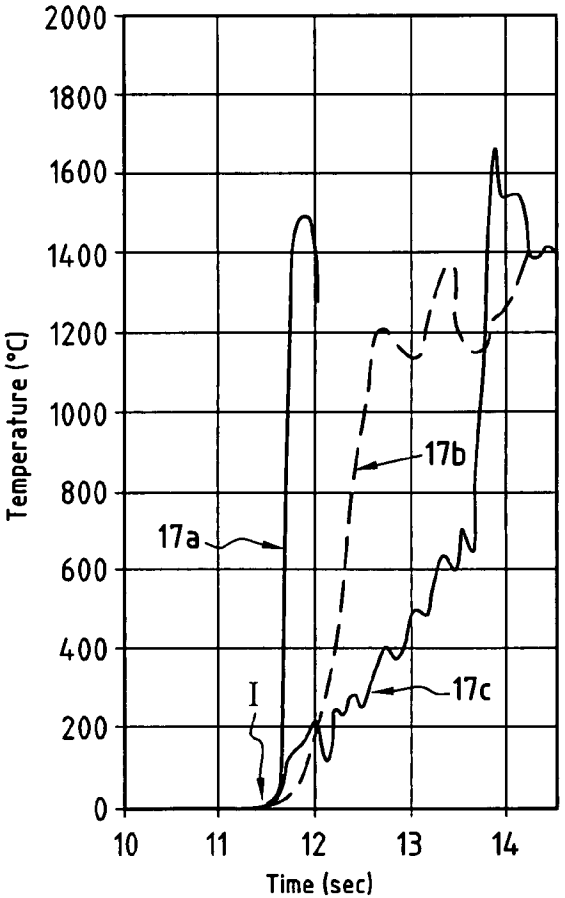

FIG. 17 shows the results obtained with two samples protected by three layers of Kraft paper and two layers of aluminized paper (curve 17*b* and 17*c*) to be compared with values from the reference wire (curve 17*a*).

Figure 18:
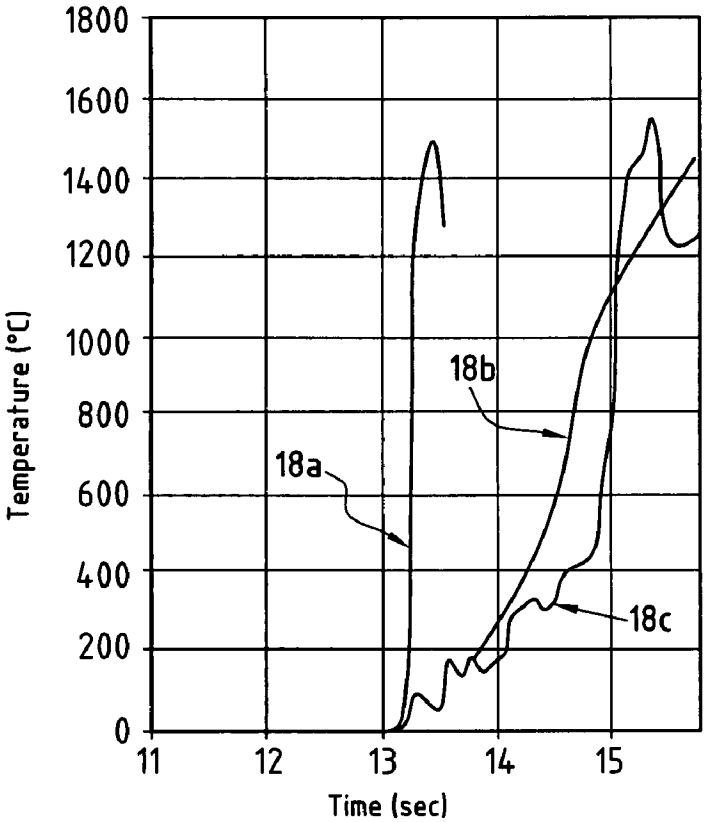

FIG. 18 allows us to compare the results obtained with six layers of Kraft paper and two layers of aluminized paper (curves 18*b* and 18*c*), to be compared with the reference rod (curve 18*a*).

The increase in temperature is slowed here by more than 1.2 seconds.

Figure 19:
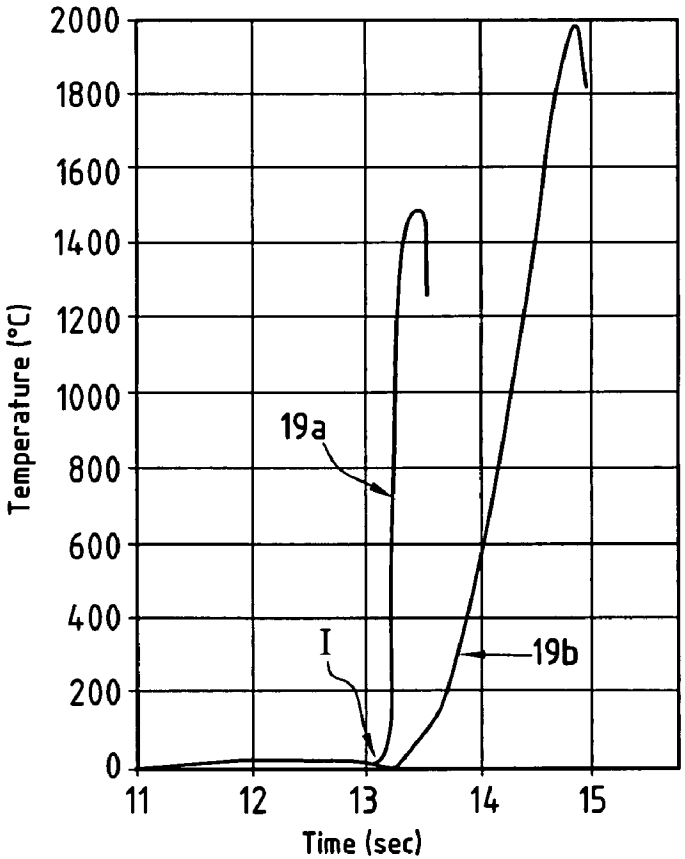

Curve 19*b* in FIG. 19 gives the results obtained for a protected with four layers of Kraft paper and a layer of aluminum, and the delay in temperature increase is 0.6 seconds relative to the reference wire, curve 19*a*.

Figure 20:
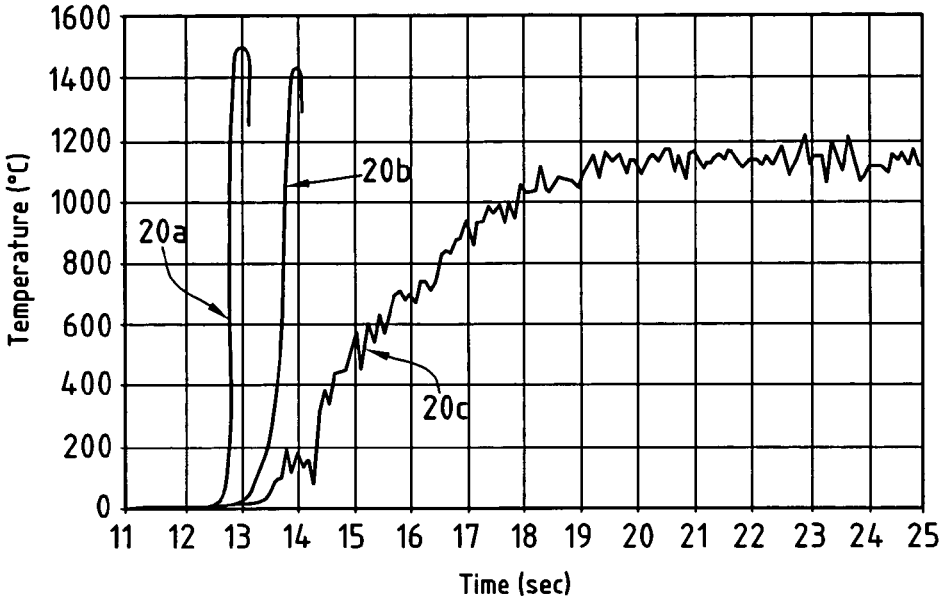

Curve 20*b* in FIG. 20 gives the result obtained with a cored wire protected by eight layers of Kraft paper and a layer of aluminum, and the delay in temperature increase is 0.8 seconds relative to the reference wire, curve 20*a*.

Curve 20*c* corresponds to a test in which the cored wire was immersed laterally into the slag and did not penetrate the molten steel, where this test indirectly gives the slag temperature, that is, 1200° C.

Figure 21:
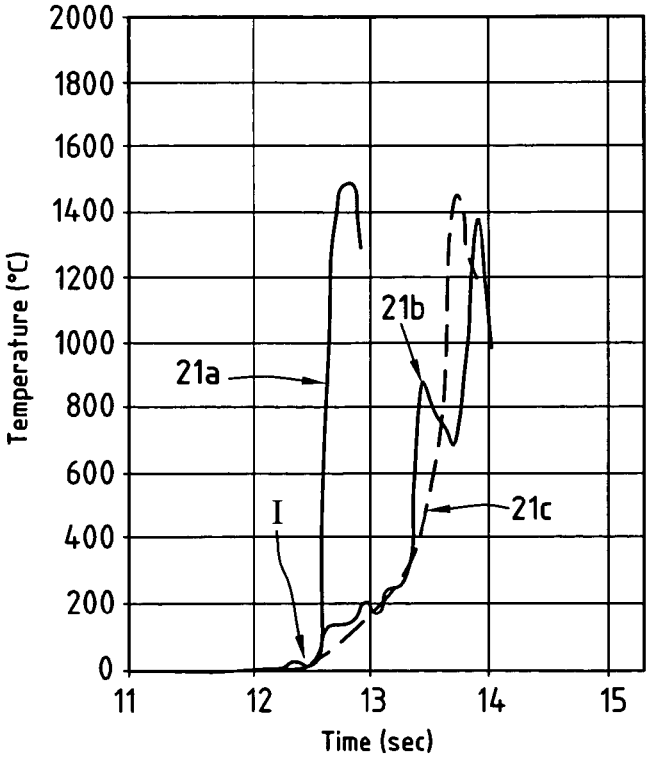

Curves 21*b* and *c* in FIG. 21 give the results obtained for cored wire protected by two layers of aluminized paper, and the delay in temperature increase was about 0.7 seconds relative to the reference wire, curve 21*a*, and these results are to be compared with those in FIG. 18.

The numerical and experimental results presented above in reference to FIGS. 2 through 12 confirm that the layers of paper that are outside a cored wire constitute a thermal insulator that allows protection of these cored wires for periods of between 0.6 and 1.6 seconds, relative to a conventional cored wire.

The applicant has discovered that this protective effect is obtained by pyrolysis of the paper in the liquid metal bath, where the paper must be protected from all combustion, notably during its free travel above the liquid metal bath, in the ladle.

Risk of combustion can be limited by injection of argon above the liquid metal ladle or by soaking the paper in water or by covering the paper with a metallic strip.

Document FR-2.810.919 by the applicant describes the placement of the thermal insulating paper between an outer steel envelope and a steel liner containing the powdered or granular additive.

The outer steel liner is designed to prevent the paper from being damaged while the cored wire is being handled.

The applicant has discovered that these "hybrid" wires as described in document FR-2.810.919 do not allow us to obtain a significant delay in temperature increase to be achieved unless the paper is present in the seaming or coating zone, so as to avoid all metal/metal contact in the seaming zone, where the paper being pyrolized is in the liquid metal bath.

Experimental procedures were carried out with the cooperation of Armines, Department of Power Engineering, Ecole des Mines de Paris.

The invention claimed is:

1. Cored wire consisting of:

a powdered/granular material core, an internal metallic liner covering the material core, at least one thermal barrier layer covering the internal metallic liner, wherein said at least one thermal barrier layer is made of a material that pyrolizes upon contact with a liquid metal bath, and a soaking liquid loaded in said thermal barrier layer and said soaking liquid having a latent heat of vaporization higher than 2 MJ/kg, and in which there is no oxygen in the vicinity of thermal barrier which pyrolizes upon contact with a liquid metal bath;

said material of the thermal barrier layer has a thermal conductivity that is between 0.5 and 4 W/m.K inclusive, before pyrolysis.

2. Cored wire according to claim 1, wherein the pyrolizing material is Kraft paper, aluminized paper or a multiple layer comprising at least one strip of Kraft paper and at least one layer of aluminized paper.

3. Cored wire according to claim 2, wherein the pyrolizing material is covered with a thin metallic sheet which is separate from the Internal metallic liner.

4. Cored wire according to claim 3, wherein the thin metallic sheet is made of aluminum or aluminum alloy.

5. Cored wire according to claim 1, wherein the pyrolizing material is of a radial thickness of between 0.025 mm and 0.8 mm inclusive, before pyrolysis.

6. Cored wire according to claim 1, wherein the pyrolizing material has a pyrolysis start temperature on the order of 500° C.

7. Cored wire according to claim 1, wherein said soaking liquid is water.

8. Cored wire according to claim 7, wherein the pyrolizing material comprises a layer of dampened paper.

9. Cored wire according to claim 1, wherein the pyrolizing material is affixed by gluing the pyrolizing material to the internal metallic liner.

10. Cored wire according to claim 1, wherein the pyrolizing material is placed between the internal metallic liner and an external metallic enclosure.

11. Cored wire according to claim 10, wherein the external metallic enclosure is seamed, and the pyrolizing material is interposed inside a seaming strip, so as to prevent all direct metal/metal contact inside the seaming strip.

12. Cored wire according to claim 10, wherein the internal metallic liner has a radial thickness of between approximately 0.2 and 0.6 mm inclusive, and where the external metallic enclosure is of a radial thickness of between about 0.2 and 0.6 mm inclusive.

13. Cored wire according to claim 11, wherein the internal metallic liner has a radial thickness of between approximately 0.2 and 0.6 mm inclusive, and where the external metallic enclosure is of a radial thickness of between about 0.2 and 0.6 mm inclusive.

14. Cored wire according to claim 12, wherein the pyrolizing material is a Kraft paper, either single or multi-layer, of a thickness of between 0.1 and 0.8 mm inclusive.

15. Cored wire according to claim 13, wherein the pyrolizing material is a Kraft paper, either single or multi-layer, of a thickness of between 0.1 and 0.8 mm inclusive.

16. Cored wire according to claim 1, wherein the powder or grains of the material core are either compacted or embedded in a resin, and the material core comprises at least one material chosen from among the group consisting of Ca, Bi, Nb, Mg, CaSi, C, Mn, Si, Cr, Ti, B, S, Se, Te, Pb, $CaC_2$, $Na_2CO_3$, $CaCO_3$, CaO, MgO, and rare earth materials.

* * * * *